United States Patent [19]

Hagenbach

[11] 3,939,086

[45] Feb. 17, 1976

[54] HIGHLY CLASSIFIED OXIDIZED DEVELOPER MATERIAL

[75] Inventor: Robert J. Hagenbach, Rochester, N.Y.

[73] Assignee: Xerox Corporation, Stamford, Conn.

[22] Filed: July 18, 1974

[21] Appl. No.: 489,630

Related U.S. Application Data

[60] Division of Ser. No. 369,036, June 11, 1973, Pat. No. 3,849,182, which is a continuation-in-part of Ser. No. 834,862, June 19, 1969, abandoned.

[52] U.S. Cl. ..... 252/62.1 P; 75/.5 R; 148/31.5; 209/71; 427/216; 427/221

[51] Int. Cl.[2] ..... G03G 9/10

[58] Field of Search..... 252/62.1; 75/.5 R, 124; 117/100 M; 148/31.5; 427/216, 221; 209/71

[56] References Cited

UNITED STATES PATENTS

| | | | |
|---|---|---|---|
| 2,618,551 | 11/1952 | Walkup | 252/62.1 |
| 2,638,416 | 5/1953 | Walkup et al. | 252/62.1 |
| 3,093,039 | 6/1963 | Khinfrank | 252/62.1 |

*Primary Examiner*—Mayer Weinblatt
*Assistant Examiner*—John D. Smith

[57] ABSTRACT

An electrostatographic developer mixture comprising finely-divided toner particles electrostatically adhering to the surface of highly shape-classified low carbon hypereutectoid steel carrier particles, the steel carrier particles comprising carrier cores having a composition comprising about 95.0 to 99.0 parts iron, 0.1 to 2.0 parts carbon, 0.5 to 2.0 parts manganese, 0.5 to 2.0 parts silicon, 0.03 to 0.1 parts aluminum, 0.01 to 0.05 parts phosphorus, and 0.02 to 0.05 parts sulphur, said carrier cores having been heat treated to a tempered martensitic microstructure with an average hardness of 40–55 Rockwell C and then overcoated with a coating material capable of electrostatically releasing toner particles adhered thereto to an electrostatic latent image. Processes of employing said developer mixture in electrostatographic imaging systems are also disclosed.

9 Claims, No Drawings

HIGHLY CLASSIFIED OXIDIZED DEVELOPER MATERIAL

BACKGROUND OF THE INVENTION

This application is a divisional application of copending application Ser. No. 369,036 filed June 11, 1973 now U.S. Pat. No. 3,849,182 which is a continuation-in-part of U.S. Ser. No. 834,862 filed on June 19, 1969, now abandoned.

This invention relates in general to an imaging system and, more particularly, to an electrostatographic material.

Electrostatography is best exemplified by the process of xerography as first described in U.S. Pat. No. 2,297,691 to C. F. Carlson. In this process a photoconductor is first provided with a uniform electrostatic charge over its surface and is then exposed to an image of activating electromagnetic radiation which selectively dissipates the charge in illuminated areas of the photoconductor while the charge in the non-illuminated areas is retained thereby forming an electrostatic latent image. This electrostatic latent image is then developed or made visible by the deposition of finely-divided electroscopic marking particles referred to in the art as "toner." The toner will normally be attracted to those areas of the layer which retain a charge, thereby forming a toner image corresponding to the electrostatic latent image. This powdered image may then be transferred to a support surface such as paper. The transferred image may subsequently be permanently affixed to the support surface as by fusing. Instead of forming latent images by uniformly charging a photoconductive layer and then exposing the layer to a light-and-shadow image, an image may be formed by directly charging the layer or an insulating member in image configuration. The powder image may be fixed to the imaging layer if elimination of the powder image transfer step is desired. Other suitable means such as solvent or overcoating treatment may be substituted for the foregoing heat fixing steps.

Several methods are known for applying the electroscopic particles to the electrostatic latent image to be developed. One well-known commercial method for developing electrostatic images is the "cascade" process disclosed by L. E. Walkup in U.S. Pat. No. 2,618,551 and E. N. Wise in U.S. Pat. No. 2,618,552. In this method a developer material comprising relatively large carrier beads having fine toner particles electrostatically coated thereon is conveyed to or rolled or cascaded across the electrostatic image-bearing surface. The composition of the carrier particles is so chosen as to triboelectrically charge the toner particles to the desired polarity. As the image cascades or rolles across the image-bearing surface, the toner particles are electrostatically deposited and secured to the charged portion of a latent image and are not deposited on the uncharged or background portion of the image. Most of the toner particles accidentally deposited in the background areas are removed by the rolling carrier, due apparently to the greater electrostatic attraction between the toner and carrier than between the toner and the discharged background. The carrier and excess toner are then recycled.

In most commercial processes the cascade technique is carried out in automatic machines. In these machines small buckets on an endless belt conveyor scoop the developer mixture comprising relatively large carrier beads and smaller toner particles and convey to a point above an electrostatic image-bearing surface where the developer mixture is allowed to fall and roll by gravity across the image-bearing surface. The carrier beads along with any unused toner particles are then returned to the sump for recycling through the developing system. Small quantities of toner material are periodically added to the developer mixture to compensate for the toner depleted during the development process. This process is repeated for each copy produced in the machine and is ordinarily repeated many thousands of times during the usable life of the developer mixture. It is apparent that in this process, as well as in other development techniques, the developer mixture is subjected to a great deal of mechanical attrition which tends to degrade both the toner and carrier particles. This degradation, of course, occurs primarily as a result of shear and impact forces due to the tumbling of the developer mixture on the image-bearing plate and the movement of the bucket conveyor through the developer material in the sump.

In prior art processes both coated and uncoated carrier beads were employed with varying degress of success. However, coated carrier beads are subject to deterioration or degradation characterized by the separation of portions of or the entire carrier coating from the carrier core. The separation may be in the form of chips, flakes, or entire layers and is primarily caused by poorly adhering coating materials which fail upon impact and abrasive contact with machine parts and other carrier particles. Carriers having coatings tend to chip and otherwise separate from the carrier core and must be frequently replaced, thereby increasing expense and consuming time. Print deletion and poor print quality occur when carrier particles having damaged coatings are not replaced. Fines and grit formed by the carrier coating disintegration tend to drift and form unwanted deposits on critical machine parts. In addition, the triboelectric properties of the carrier material vary with deterioration of the coating resulting in poor print quality.

Uncoated carrier beads, on the other hand, have three main deficiencies. First, often they lack the weight required to insure against adherence of the granular carrier material to the charged plate. Desirably, the specific gravity of the carrier material should be between about 3 and about 8. Heavier carrier bead materials cause impact damage to the surface of the image bearing layer. Secondly, the prior art uncoated carrier materials lacked the triboelectric qualities required of an electrostatographic material. Problems encountered when carrier materials lack these properties are set out in the following discussion. In the reproduction of high contrast copies such as letters, tracings, and the like, it is desirable to select the electroscopic powder and carrier materials so that their mutual electrification is relatively large; the degree of such electrification being determined in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. Although the image density described in the immediately preceding sentence may be improved by increasing the toner concentration in the developer mixture, undesirably high background toner deposition as well as increased toner impaction and agglomeration is encountered when the developer mixture is overtoned. The initial electrostatographic plate charge may be increased to improve the density of the deposited powdered image but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials but also because a high potential causes the carrier particles to adhere to the electrostatographic plate surface rather than merely roll across and off the electrostatographic plate surface. Print deletion and massive carryover of carrier particles often occur when carrier particles adhere to reusable electrostatographic imaging surfaces. Massive carrier carryover problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surfaces during image transfer and surface cleaning operations. It is, therefore, apparent that many materials which otherwise have suitable properties for employment as carrier particles are unsuitable because they possess too high a triboelectric value. Desirably, the triboelectric value for conventional electrostatography measured in micro-coulombs per gram of toner should be between 8 and 30.

Finally, the triboelectric value of a carrier material should not be significantly affected by ambient humidity conditions since such effect would destroy print quality at higher humidities and complicate machine design and operation. Many prior art uncoated materials were never commercially successful because of their great humidity sensitivity.

SUMMARY OF THE INVENTION

It is, therefore, an object of this invention to provide a system for developing electrostatic latent images which overcome the above-noted deficiencies.

It is another object of this invention to provide a system for developing electrostatic latent images which is relatively insensitive to humidity conditions.

It is another object of this invention to provide a carrier material which is relatively resistant to abrasion.

It is another object of this invention to provide a carrier material which has relatively improved triboelectric properties.

It is another object of this invention to provide a carrier material which has a relatively high density.

It is still another object of this invention to provide a carrier core material which allows for greater adhesion of carrier coating materials.

It is yet another object of this invention to provide a coated carrier material which is not subject to deterioration or degradation.

It is a further object of this invention to provide a carrier material wherein the carrier coating does not separate from the core material during machine operation.

The foregoing objects and others are accomplished in accordance with this invention by providing highly shape-classified low carbon hypereutectoid steel beads which have been heat treated to a tempered martensitic microstructure with an average hardness of 40–55 Rockwell C for use as an electrostatographic carrier core. The highly shape-classified low carbon hypereutectoid steel bead electrostatographic carrier cores of this invention comprise about 95.0 to 99.0 parts iron, 0.1 to 2.0 parts carbon, 0.5 to 2.0 parts manganese, 0.5 to 2.0 parts silicon, 0.03 to 0.1 parts aluminum, 0.01 to 0.05 parts phosphorus, and 0.02 to 0.05 parts sulphur. One of the desirable properties of this type of core material is that the slight porosity of its surface area improves and yields greater adhesions of polymer coatings. Another desirable property of the electrostatographic carrier core materials of this invention is the presence of a rough surface thereon obtained by the aforementioned heat treatment in an air or oxygen atmosphere at temperatures ranging between about 500° and about 1000°F. The heat treatment of the core material provides oxidized carrier cores having a surface oxide layer comprising $Fe_3O_4$ of a thickness between about 0.2 and about 5.0 microns. It has been found that thus oxidized low carbon hypereutectoid steel carrier beads when subsequently coated with polymer materials provide coated electrostatographic carrier beads having increased coating to core adhesion resulting in longer machine life, less gritting characteristics, and permitting faster machine speeds. Particularly good adhesion of carrier coatings to the core material is obtained with an oxidized surface carrier core composition comprising about 96.0 to 98.0 parts iron, 0.85 to 1.5 parts carbon, 0.9 to 1.2 parts manganese, 0.9 to 1.2 parts silicon, 0.035 to 0.045 parts aluminum, 0.015 to 0.05 parts phosphorus, and 0.03 to 0.05 parts sulphur. Optimum adhesion of carrier coatings to core material is obtained with an oxidized surface carrier core composition comprising about 96.9 parts iron, 1.0 part carbon, 1.0 part manganese, 1.0 part silicon, 0.04 parts aluminum, 0.015 parts phosphorus, and 0.035 parts sulfur.

The polymer coated carrier beads of this invention have a minimum density of about 7.0 grams per cubic centimeter.

The raw low carbon hypereutectoid steel beads when received as manufactured generally are not satisfactory for use as electrostatographic carrier cores because they usually contain at least about thirty percent by weight of non-round materials. The raw steel beads are generally manufactured by the so-called Rotating Electrode Process or in an electric arc furnace well known in the metals processing industry. In the Rotating Electrode Process, a rapidly rotating electrode, on the order of 5,000 to 12,000 RPM, of the metal to be spheroidized is made molten by an electric arc from an opposing stationary tungsten electrode. Centrifugal forces throw off the molten droplets of metal which solidify in a chosen controlled atmosphere, for example, helium, before hitting the walls of a cylindrical collection chamber surrounding the electrodes. Thus, although spheroidal particles are produced, a mixture of round and irregularly shaped particles generally result. Non-round materials are undesirable because they contain slag, hollow particles, chip particles, and flat particles which cause variations in electrostatographic carrier bead density resulting in carrier bead sticking to electrostatographic photoreceptor drum surfaces causing print deletions, scratches on the photoreceptor drum, and non-uniform developer triboelectric properties. In addition, undersized particles create machine leakage problems and oversized particles lessen the amount of developability, that is, edge definition and background levels suffer in quality. Consequently, the raw steel beads must be sized and classified for usage as electrostatographic carrier cores.

In accordance with this invention, one method of obtaining highly shape-classified steel carrier cores is by mechanically separating round from irregularly-shaped beads through controlled vibration such as by employing a vibrating table set at a predetermined slope. A particularly useful vibrating table for classifying round beads in the 100 micron size range is TAFA Model 41-5 Vibrating Table available from TAFA Division, Humphreys Corp., Bow-Concord, New Hampshire. For separating 250 and 450 micron round carrier core material from non-round materials, a particularly useful method is by employing a Krussow Double Spiral Separator available from Cleland Manufacturing Company, Minneapolis, Minnesota. For obtaining the highly shape-classified 250 micron and 450 micron steel carrier cores, respectively, of this invention, it was found that the 3½ spiral width and the 5½ spiral width, respectively, of the aforementioned separator provided better than 95.0 percent rounds and the removal of all flakes and non-rounds with no appreciable loss of round material.

It has been found that the highly shape-classified low carbon hypereutectoid oxidized steel carrier beads of this invention when coated with a polymer coating provide satisfactory results in an electrostatographic device when at least about 95 percent of the carrier beads have been classified as rounds. For even better results, it is preferred that at least about 97 percent of the carrier beads have been classified as rounds. Optimum results in an electrostatographic device are obtained when at least about 98 percent of the carrier beads have been classified as rounds. As an indication of the value of shape-classified carrier beads, the voltage required to adhere carrier beads of various roundness percentages was measured by rolling developer mixtures prepared therefrom down an electrode inclined at 25°. It was found that as the percentage of round classified carrier beads increased, so did the voltage required to adhere the carrier beads to the electrode. For example, at about 25 percent rounds, the voltage required was about 360; at about 50 percent round, the voltage required was about 440; at about 75 percent rounds, the voltage required was about 570; and at about essentially 100 percent rounds, the voltage required was about 860. Thus, as the percentage of round carrier beads increases so does the voltage required to cause carrier bead sticking on an electrically charged surface such as a photoreceptor drum. Therefore, when employing highly shape-classified carrier beads in an electrostatographic development system, carrier bead sticking is minimized, photoreceptor surface scratching and damage is likewise minimized, and print quality is greatly improved.

After classification, the carrier cores may be coated with any suitable carrier coating material. Typical carrier coating materials include natural resin, thermoplastic resin, or partially cured thermosetting resin. Typical natural resins include: caoutchouc, colophony, copal, dammar, dragon's blood, jalep, storax, and mixtures thereof. Typical thermoplastic resins include: the polyolefins such as polyethylene, polypropylene, chlorinated polyethylene, and chlorosulfonated polyethylene; polyvinyls and polyvinylidenes such as polystyrene, polymethylstyrene, polymethylmethacrylate, polyacrylonitrile, polyvinylacetate, polyvinylalcohol, polyvinylbutyral, polyvinylchloride, polyvinylcarbazole, polyvinyl ethers, and polyvinyl ketones; fluorocarbons such as polytetrafluoroethylene, polyvinylfluoride, polyvinylidene fluoride; and polychlorotrifluoroethylene; polyamides such as polycoproloctamo and polyhexamethylene adipimide; polyesters such as polyethylene terephthalate; polyurethanes; polysulfides; polycarbonates; and mixtures thereof. Typical thermosetting resins include: phenolic resins such as phenol formaldehyde, phenol furfural and resorcinol formaldehyde; amino resins such as urea formaldehyde and melamine formaldehyde; polyester resins; epoxy resins; and mixtures thereof. A styrene-methacrylate-organosilicon terpolymer carrier coating composition such as described in U.S. Pat. No. 3,526,533 is particularly preferred because of its excellent triboelectric characteristics. The highly shape-classified oxidized carrier core materials of this invention may be coated with carrier coating material by any conventional carrier coating technique, such as, for example, the technique described in U.S. Pat. No. 2,618,551.

After the highly shape-classified carrier beads of this invention are coated with carrier coating material, the coated carrier beads are screened to remove any agglomerates formed during the coating process. The screen mesh sizes employed naturally depend upon the carrier bead size desired. The thus-obtained carrier beads are now ready for mixing with an appropriate toner material to provide a developer mixture.

Any suitable pigmented or dyed electroscopic toner material may be employed with the carriers of this invention. Typical toner materials include: gum copal; gum sandarac; rosin; cumaromeindene resin; asphaltum; phenol formaldehyde resins; rosin modified phenol formaldehyde resins; methacrylic resins; polystyrene resins; polypropylene resins; epoxy resins; polyethylene resins; polyester resins; and mixtures thereof. The particular toner material to be employed usually depends upon the separation of the toner particles from the carrier beads in the triboelectric series and whether a negatively or positively charged image is to be developed. Among the patents describing electroscopic toner compositions are U.S. Pat. No. 2,659,670 to Copley, U.S. Pat. No. 2,753,308 to Landrigan, U.S. Pat. No. 3,079,342 to Insalaco, U.S. Pat. No. Re. 25,136 to Carlson, and U.S. Pat. No. 2,788,288 to Rheinfrank et al. These toners generally have an average particle diameter between about 1 and 30 microns. A toner comprising a styrene-N-butyl methacrylate copolymer, polyvinylbutyral and carbon black produced by the method disclosed by M. A. Insalaco in Example I of U.S. Pat. No. 3,079,342 is preferred because of its excellent triboelectric qualities and its deep black color.

An ultimate coated carrier particle diameter between about 50 microns to about 1,000 microns is preferred because the carrier particles then possess sufficient density and inertia to avoid adherence to the electrostatic images during the cascade development process. Adherence of carrier beads to electrostatographic drum surfaces is undesirable because of the formation of deep scratches on the surface during the image transfer and drum cleaning steps, particularly where cleaning is accomplished by a web cleaner such as the web disclosed by W. P. Graff, Jr., et al. in U.S. Pat. No. 3,186,838. Also, print deletion occurs when carrier beads adhere to electrostatographic imaging surfaces. Generally, speaking, satisfactory results are obtained when about 1 part toner is used with about 10 to about 200 parts by weight of carrier.

The developer compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, and the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin. The developer compositions of this invention provide improved print quality such as image sharpness, solid area coverage and character fill-in when employed in electrostatographic machines.

DESCRIPTION OF PREFERRED EMBODIMENTS

The following examples further define, describe, and compare methods of preparing developer materials of the present invention and of utilizing them to develop electrostatic latent images. Parts and percentages are by weight unless otherwise indicated.

EXAMPLE I

Highly shape-classified 100 micron steel cores are obtained by the following method. A TAFA Model 41-5 vibrating table available from TAFA Division, Humphreys Corp., Bow-Concord, New Hampshire, is placed on a firm bench or table. Using an inclinometer, such as available from Berger Instruments, Boston, Mass., the table slope is adjusted to provide about 2° decline from back to front and about 1.5° decline from the feed-side to the discharge-side. The vibration amplitude rheostat is set at about 32. The table is cleaned with a camel hair brush to remove dust which impedes the flow of carrier core. A feeder, such as Syntron Model EB-70 Parts Feeder available from Syntron Division, FMC Corporation, Homer City, Pa., isolated from table vibration, is regulated to provide a steady material flow with good dispersion across the vibrating table. The two carrier core fractions are collected in the respective round and non-round collection containers. In this way, 100 micron carrier core particles are mechanically separated into round and irregularly shaped beads as to provide highly shape-classified carrier cores.

EXAMPLE II

Highly shape-classified 250 micron steel carrier cores are obtained by the following method. The as-received carrier cores are poured into a gravity separator, such as the Krussow Double Spiral Separator available from Cleland Manufacturing Company, Minneapolis, Minnesota, employing a 3½ spiral width. The rounds are consolidated into one container. In this way, highly shape-classified carrier core particles being at least about 95.0 percent rounds are obtained and flaked, non-round, irregularly shaped particles are separated from the starting material with no appreciable loss of round material.

EXAMPLE III

A highly shape-classified 250 micron coated carrier material is prepared as follows. The carrier core material comprises about 96.9 parts iron, 1.0 part carbon, 1.0 part manganese, 1.0 part silicon, 0.04 parts aluminum, 0.15 parts phosphorus, and 0.035 parts sulphur. The surface of the carrier core material has an oxide layer comprising $Fe_3O_4$ of about 1.0 micron in thickness obtained by heat treating the carrier cores at about 900°F in an air atmosphere for about 6 hours. The oxidized carrier core material was exposed to a 0.05 M $CuSO_4$ solution to ascertain the degree of surface oxidation. Theoretically, the copper should plate any area of the carrier core not having an oxide coating. By the foregoing, only a few carrier beads became plated with copper. The carrier beads were then classified to obtain at least about 95.0 percent rounds in accordance with Example II. The highly shape-classified carrier beads were then coated with about 0.28 percent by weight, based on the weight of the beads, of the methyl terpolymer coating composition disclosed in U.S. Pat. No. 3,526,533 and wherein the coating composition contained about 8.0 percent by weight, based on the weight of the coating composition, of DuPont Oil Red dye. The highly shape-classified coated carrier beads are then screened to remove any agglomerated particles. The classified and screened coated carrier cores are then evaluated for carrier coating abrasion resistance according to the following procedure: Approximately 25.0 grams of coated carrier beads are weighed to the nearest 0.1 milligram and placed in a 250 ml stainless steel beaker fitted with a rubber stopper. The beaker and the carrier beads are agitated on a Red Devil Paint shaker for 15 minutes. The stopper is removed and any particles adhering thereto are carefully washed into the beaker with a wash bottle. 100 Ml of distilled water and two drops of Triton X-100, a nonionic wetting agent available from Rohm & Haas, Philadelphia, Pa., are added to the beaker. The mixture is agitated for 30 seconds at 7 amps using a Branson Sonifier. The mixture is carefully filtered through a 5 micron cellulose, millipore filter weighed to the nearest 0.1 milligram. The mixture is washed with two additional 100 ml portions of distilled water and filtered. The filter paper is dried to constant weight in a circulating air oven at 60°C. The coating weight removed is determined by subtracting the original filter weight from the final weight. The coating weight removed was found to be about 17.0 percent.

A developer mixture is prepared by mixing about 100 parts of the highly shape-classified coated carrier beads obtained with about one part of toner material comprising styrene-n-butyl methacrylate copolymer, polyvinylbutyral and carbon black produced by the method disclosed in Example I of U.S. Pat. No. 3,079,342 having an average particle size of about 10 to about 20 microns. The developer mixture is cascaded across an imaging surface bearing a positively charged electrostatic image. The resulting developed image is transferred by electrostatic means to a sheet of paper whereon it is fused by heat. The resulting image is dense and substantially free of background toner deposits. After the development of about 13,000 images, the carrier material is examined. The material overcoating the carrier core is found not to have flaked, separated, or deteriorated in any manner.

EXAMPLE IV

A coated carrier material is prepared as follows. The carrier core material comprises about 96.9 parts iron, 1.0 part carbon, 1.0 part manganese, 1.0 part silicon, 0.04 parts aluminum, 0.15 parts phosphorus, and 0.035 parts sulphur. The carrier core material is not heat-treated as in Example III and has substantially no oxide layer thereon. The carrier core material was exposed to a 0.05 M $CuSO_4$ solution to determine the degree of surface oxidation. Substantially all of the carrier core material became plated with copper indicating substantially no surface oxidation. The carrier core material was then classified, coated, screened, and evaluated for carrier coating abrasion resistance as in Example III. The coating weight removed was found to be about 73.0 percent.

A developer mixture is produced by mixing about 100 parts of the coated carrier beads with about one part of the toner material described in Example III and employed as in Example III to develop an imaging surface bearing a positively charged electrostatic image. After development of several hundred images, the carrier material is examined. The material overcoating the carrier core is found to have flaked, separated, and deteriorated. The developed images are found to have hollow characters, poor edge definition, and contain an unsatisfactory level of background deposits. These results show that an oxidized carrier substrate provides a much stronger coating/core bond providing much improved carrier coating adhesion with resulting improved print quality.

EXAMPLE V

The carrier material of Example III was evaluated for carrier coating abrasion resistance as in Example III except that the carrier cores were coated with 0.2 percent and 0.6 percent coating weights. The object was to determine the effect of coating weight on abrasion resistance. The results, based on the abrasion test, indicate that carrier coating abrasion resistance is not influenced by coating weight.

EXAMPLE VI

250 Micron size carrier core material comprising about 98.9 parts iron, 0.1 parts carbon, 0.5 parts manganese, 0.5 parts silicon, 0.03 parts aluminum, 0.01 parts phosphorus, and 0.02 parts sulphur was oxidized in an air atmosphere under various conditions in a Lindberg Hevi-Duty Oven to determine the effect on carrier coating abrasion resistance. All trials were run at 500°C with the only variable being time of treatment. The as-received core material was poured into a crucible and placed in the oven. The power for the oven was switched on and the temperature controls were set for 500°C. When the control temperature was reached, the treatment was begun. After the desired treatment time, the crucible was removed from the oven and allowed to air cool overnight. Oxidation times allowed were 1, 3, and 7 hours. Samples of the as-received carrier core material and the carrier core materials air-oxidized for 1, 3, and 7 hours, respectively, were then coated with 0.28 percent by weight, based on the weight of the carrier cores, with the coating composition of Example III. The four sets of carrier materials were evaluated for carrier coating abrasion resistance in accordance with the procedure set forth in Example III. It was found that the asreceived coated core sample provided the poorest carrier coating abrasion resistance losing about 71.0 percent total coating after 15 minutes agitation. The core material sample air-oxidized for one hour lost about 54.0 percent total coating after 15 minutes agitation; the core material sample air-oxidized for three hours lost about 55.0 percent total coating after 15 minutes agitation; and the core material sample air-oxidized for 7 hours lost about 43.0 percent total coating after 15 minutes agitation. Thus, a significant improvement in the coating adhesion to carrier core was observed in the air-oxidized samples.

Although specific components and proportions have been stated in the above description of preferred embodiments of the invention, other typical materials as listed above where suitable may be used with similar results. In addition, other materials may be added to the mixture to synergize, enhance, or otherwise modify the properties of the carrier beads. For example, a material to improve the sphericity of the beads may be incorporated during manufacture.

The expressions "developer" and "developing material" as employed herein are intended to include electroscopic toner material or combinations of toner material and carrier material.

Other modifications and ramifications of the present invention will occur to those skilled in the art upon a reading of this disclosure. These are intended to be included within the scope of this invention.

What is claimed is:

1. An electrostatographic developer mixture consisting essentially of about one part by weight of finely-divided toner particles electrostatically adhering to the surface of about 10 parts to about 200 parts by weight of highly shape-classified low carbon hypereutectoid steel carrier particles having an average particle size between about 50 microns and about 1,000 microns and a specific gravity of at least about 7 grams per cubic centimeter, said steel carrier particles having been heat treated to a tempered martensitic microstructure with an average hardness of 40–55 Rockwell C in an air or oxygen atmosphere at temperatures ranging between about 500° and about 1,000°F to provide an oxide surface layer comprising $Fe_3O_4$ on said steel carrier material, said oxide surface layer having a thickness between about 0.2 and about 5.0 microns, said steel carrier particles comprising carrier cores having a composition comprising about 95.0 to about 99.0 parts iron, about 0.1 to about 2.0 parts carbon, about 0.5 to about 2.0 parts manganese, about 0.5 to about 2.0 parts silicon, about 0.03 to about 0.1 parts aluminum, about 0.01 to about 0.05 parts phosphorus, and about 0.02 to about 0.05 parts sulphur, said treated carrier particles being overcoated with a resinous coating material capable of electrostatically releasing said electrostatically adhering toner particles to an electrostatic latent image.

2. An electrostatographic developer mixture according to claim 1 wherein said carrier cores comprise about 96.0 to about 98.0 parts iron, about 0.85 to about 1.5 parts carbon, about 0.9 to about 1.2 parts manganese, about 0.9 to about 1.2 parts silicon, about 0.035 to about 0.045 parts aluminum, about 0.015 to about 0.05 parts phosphorus, and about 0.03 to about 0.05 parts sulphur.

3. An electrostatographic developer mixture according to claim 1 wherein said carrier cores comprise about 96.9 parts iron, about 1.0 parts carbon, about 1.0 parts manganese, about 1.0 parts silicon, about 0.04 parts aluminum, about 0.015 parts phosphorus, and about 0.035 parts sulphur.

4. An electrostatographic developer mixture according to claim 1 wherein said highly shape-classified steel carrier particles comprise at least about 95 percent by weight of round carrier particles.

5. An electrostatographic developer mixture according to claim 1 wherein said highly shape-classified steel carrier particles are essentially free of non-round carrier particles.

6. An electrostatographic developer mixture according to claim 1 wherein said highly shape-classified steel carrier particles are obtained by mechanically separating round carrier particles from irregularly-shaped particles through controlled vibration.

7. An electrostatographic developer mixture according to claim 1 wherein said highly shape-classified steel carrier particles are obtained by separating non-round particles from round carrier particles by employing a double-spiral separator.

8. An electrostatographic developer mixture according to claim 1 wherein at least about 95 percent of said steel carrier particles have been classified as rounds.

9. An electrostatographic developer mixture according to claim 1 wherein said carrier coating material consists essentially of a styrene-methacrylate-organosilcon terpolymer.

* * * * *